United States Patent [19]

Zur

[11] 4,181,995

[45] Jan. 8, 1980

[54] MODULAR STRUCTURE FOR BRIDGES, OVERPASSES AND ROADWAYS

[76] Inventor: Henry C. Zur, 10 W. Griswold Ave., Phoenix, Ariz. 85021

[21] Appl. No.: 841,096

[22] Filed: Oct. 11, 1977

[51] Int. Cl.[2] ..... E01D 1/00

[52] U.S. Cl. ..... 14/1; 404/1; 104/126

[58] Field of Search ..... 404/1; 14/1, 695; 104/30, 118, 126

[56] References Cited

U.S. PATENT DOCUMENTS

| | | | |
|---|---|---|---|
| 712,896 | 11/1902 | Barker | 14/1 |
| 1,970,979 | 8/1934 | Robb | 14/1 |
| 2,225,186 | 12/1940 | Sorensen | 404/1 |
| 3,662,656 | 5/1972 | Finsterwalder | 404/1 |
| 3,811,147 | 5/1974 | Dix | 404/1 X |

FOREIGN PATENT DOCUMENTS

| | | | |
|---|---|---|---|
| 348722 | 5/1931 | United Kingdom | 404/1 |
| 915483 | 1/1963 | United Kingdom | 404/1 |
| 1024007 | 3/1966 | United Kingdom | 404/1 |

*Primary Examiner*—Nile C. Byers, Jr.

[57] ABSTRACT

A bridging structure of modular elements to carry road or rail traffic over crossings, bodies of water and as elevated roadways to provide additional lanes over and parallel to existing roads and freeways, and to provide elevated roadways along and over canals and rivers. Mainly intended to provide quickly assembled and relative inexpensive overpasses and constant flow traffic lanes for a certain part of the traffic, leaving more space for heavier traffic at the existing ground levels, and reducing pollution and fuel consumption from idling engines.

11 Claims, 16 Drawing Figures

FIG_10
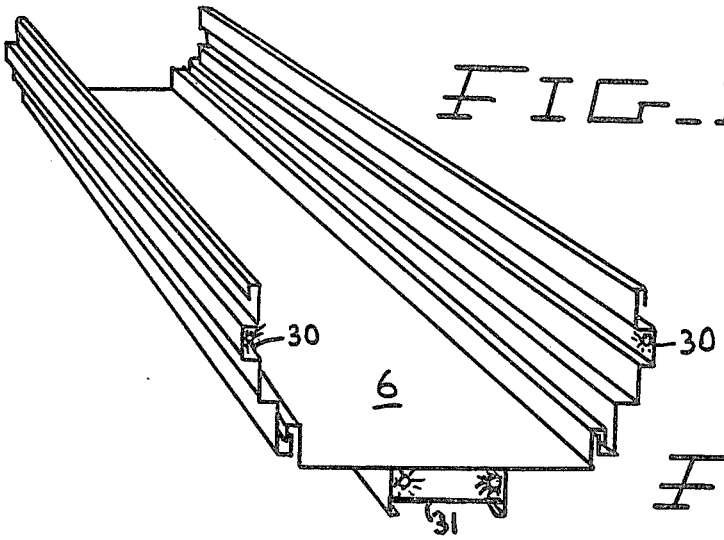
FIG 12
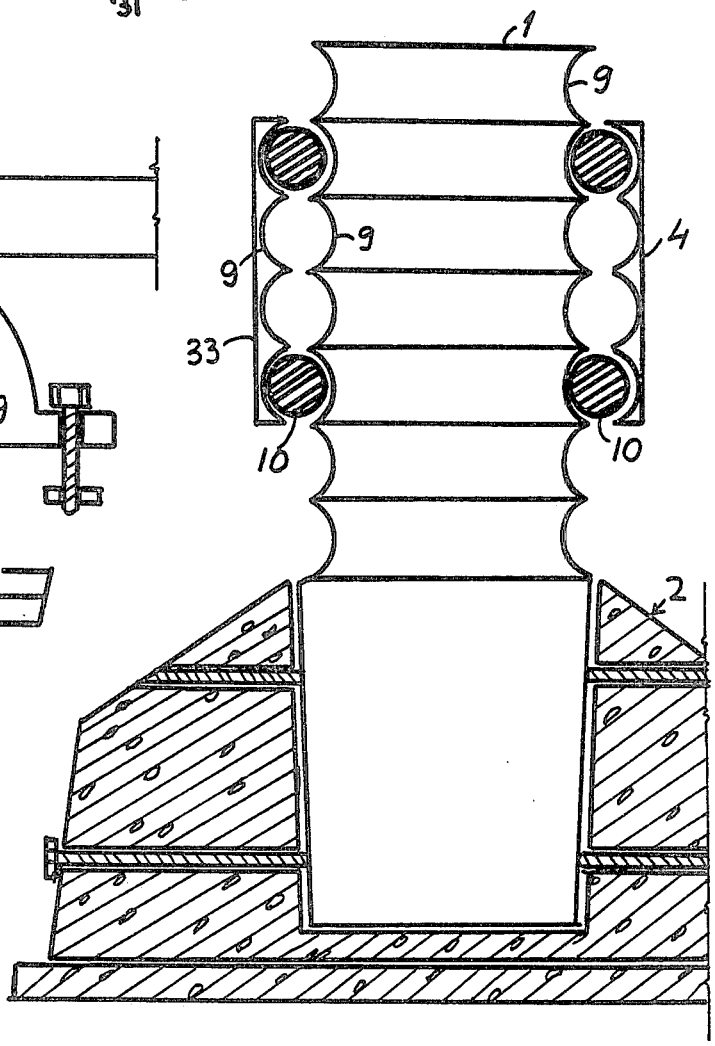
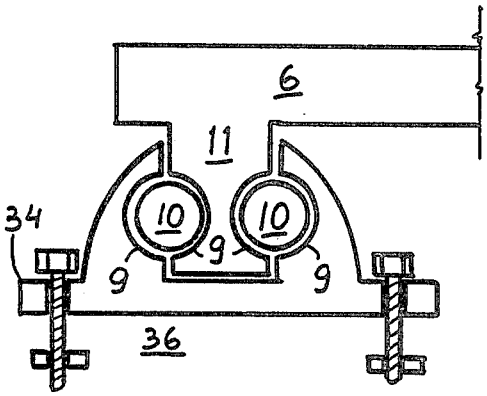
FIG 13

MODULAR STRUCTURE FOR BRIDGES, OVERPASSES AND ROADWAYS

The modular assembly structure comprises base elements which are placed on at the erection site prepared foundation plates, columns inserted and adjusted for alignment into the bases, cross beams positioned on the columns at the respective required height by means of inserting special cores dimensioned to fit the respective grooves of the fluted column and beams, traffic carrying elements placed from column/beam to column/beam and secured by cores inserted between the fluted beams and the fluted base part of the traffic carrying element and fitting into their respective grooves.

The carrying elements can be positioned on top of the column, on each side of the columns, between the columns and in as many levels as required.

The present invention relates mainly to prefabricated structures and is primarily concerned to provide a structural sound modular system composed of relative few main elements which can be positioned, assembled and secured in a relative short time, and with a minimum of obstruction to existing traffic flow. The novel system of assembly can be utilized for various other structures, and the herewith provided novel system for positioning, resting and securing by means of cores and respective grooves on the elements to be assembled, can be utilized to position securely and with a certain degree of flexibility, heavy structures and especially bridges which at present rest on their bases only, and are liable to fly off when the unusual pressure from below is exerted such as from earthquakes and bombs. A further important novel idea is the primarily intended use for vehicles of low weights and restricting that use to provide low cost overpasses and elevated roadways, and leaving the heavier traffic to use the existing ground levels.

An additional important novel feature is the suggested use of "U" type channels as traffic carrying elements, thereby providing the lowest possible degree of visibility, combining strength, and a maximum of security for passing vehicles which are driving within the sides of the "U", and the benefit of feeling secure this type of structure provides to drivers. When traffic carrying elements are required to provide lane changes the two parallel carrying elements have one side respectively constructed downward, leaving a free center for changing lanes. Conduits can be provided in the carrying elements to provide space for utilities to be carried.

BACKGROUND OF THE INVENTION

Although building of bridge type structures with prefabricated elements have been known for sometime and mainly used by the military no satisfactory system has so far been introduced which would serve the long felt need for a relative inexpensive system of bridge type structures rights of way and with little obstruction to traffic flow, and which could provide overpasses at crossings and elevated roadways.

Another long-felt need is for a quickly assembled structure to act as a temporary roadway or deviation while a main building project is in progress, and to be disassembled and ready for reuse, when no more requied.

Presently such structures are built mainly on location with only a limited use of prefabricated elements, in relative long building times, sometimes obstructing traffic for periods of 12 months and more, and causing great losses to the businesses served by those obstructed roads. Sometimes, because of these obstructed roads, traffic adopts even entirely new patterns and does not return to these roads with their new and very costly overpasses.

Some modular systems have lately been developed and patented. These are mainly systems of precast concrete elements intended mainly for heavy type bridging and made up of a relative great number of elements. These have not been found to provide advantages, being mostly cumbersome in assembly and looks, and have therefore not found acceptance, especially as they do not provide complete systems.

It has been customary so far to build overpasses with conventional methods for carrying or deviating all the traffic at a great expense and long time periods causing great hardships to the general public. Even more the public is exposed to continuing hardships on roads without overpasses, especially where a national or a long distance highway passes through urban centers causing traffic to pile up at the crossings, adding unnecessary pollution and increased fuel consumption by idling engines. No system has so far been provided which could satisfactory serve to carry the traffic in a relative inexpensive way, in a constant flow over crossings and as elevated raodways, and to cut down traveling time, fuel consumption and pollution. No system has so far been introduced to carry the greater amount of road traffic composed of cars and vans only, although these make up over 80% of all traffic at most points, and the building of such lighter structures can be executed at a fraction of conventional costs, and the relative light structures can be built in a graceful form to find public acceptance for the important building of overpasses.

OBJECTS OF THE INVENTION

1. To provide a unified modular bridging structure, such as elevated road or rail overpasses, bridges and elevated roadways and transit systems.

2. To provide a modular bridging structure for assembly on location and in a relative short time, mainly from prefabricated parts;

3. To provide a modular bridging structure, based on interchangeable prefabricated parts, designed for any required structural strength, 4. To provide a modular bridging structure which can be assembled, disassembled and reused.

5. To provide a relative low-cost bridging structure to relieve traffic pressures, congestions at crossings in cities and in particular for highways passing through cities, 6. To provide a system for "Constant Flow" traffic on heavily traveled roads, in order to enable the roads to carry more vehicles at relative much higher speeds, and without having to stop at crossings, 7. To provide for reduction of costs in building roadways and overpasses by limiting the overpasses to carry only light weight vehicles such as cars, vans and small buses which constitute the greater part of the traffic, 8. To provide with such "Constant Flow" bridging structure a substantial reduction of air pollution caused by idling cars and slow moving traffic, 9. To provide with such bridging structure multi level roadways and multi level crossings, 10. To provide with that bridging structure additional lanes to existing roads and freeways elevated over present lanes, 11. To provide with said bridging structure elevated roadways along and over canals and rivers as means of utilizing the airspace to carry the traffic from over crowded areas, 12. To provide with said bridging structure multi level overpasses and turning lanes for constant flow of lighter vehicle traffic over crossings, by providing on a one level overpasses for the straight going traffic, at a second elevated level a left turn, and a elevated or usual lane for right turns, 13. To reduce building costs of overpasses and bridges by using said bridging structure of prefabricated elements, 14. To reduce costs of overpasses and bridges by building to carry restricted weights only, Various other more detailed objects and advantages of the invention, such as arise in connection with carrying out the above ideas in practical embodiment will, in part, become apparent and, in part, be hereinafter stated as the description of the invention proceeds.

SUMMARY OF THE INVENTION

With these foregoing objectives in mind, a bridging structure of modular elements has been developed to facilitate a relative quick and inexpensive construction of overpasses, bridges and elevated roadways.

The main elements of the bridging structure comprise:

A self supporting structure serving as roadway, preferably shaped in "U" form to combine structural strength and a relative low profile of visibility;

Beams serving as supports for the roadway structures, positioned on columns;

Columns supporting the beams;

Bases into which the columns are positioned; Cores, forming the main part of a specially devised securing and positioning bridging structure, securing one element to another by holding the whole element or part of it, between two opposing cores, dimensioned to fit flutings provided in the elements;

These elements can be assembled at a relative very short time on location, mainly from prefabricated parts. The base can be cast on location or prefabricated and placed on a foundation plate cast on the spot, the base can be provided with means to adjust the position of the column positioned on that base, and align the column with the other columns.

The beams supporting the roadways are then positioned on the columns at the required height by means of inserting cores in the respective flutings of the elements to be connected, and the roadways placed on the beams and in turn secured by means of inserting opposing cores. The roadway structures can be prefabricated as one element or be assembled on the side from a number of components. The roadway structures can be formed with ducts to carry utilities. After assembly the roadway structures are provided with road surfacing.

Whenever required, columns can be placed at two sides connected by beams supporting the roadway structures. The same type of structure can be utilized to carry railways, serve as water carrying aquaduct and in smaller variations as pedestrian crosswalks.

Another novel element is added by the idea of specially building these elevated roadways and overpasses for lightweight vehicles only. As most of the vehicles passing at busy intersections are cars and vans, the elevated structure can be built at a fraction of the cost of usual overpasses, and forming much less visible obstruction. And when limited to lighter traffic, the requirements for height and width can be reduced to provide for such elevated structure to be as graceful as possible. These observations form a basis for the invention as present day overpasses generate objections although the public is aware that only by providing overpasses and elevated roadways a solution to congestion and pollution can be found.

The invention provides many important advantages over presently used bridge and elevated roadway construction.

One is the ability to build the bridging structure as overpasses at busy intersections with a minimum of obstruction to the existing traffic. Another important advantage is the reduction of costs, especially when use of the bridging structure is made for the great amount of lighter traffic, in which case costs are reduced to a fraction of the usual expenditure for such overpasses. When used for lighter traffic, the overpasses themselves require a limited height, and therefore can also be built as multi level overpasses. Overpasses built on the basis of that invention could generally provide for all directions except for the right turn, at two elevated levels. The first elevated level would serve the cross traffic, with the ramps beginning and ending after the intersection on the crossing street. The left turn elevated roadway would begin on the other street just before the intersection with ramps leading up to the first elevated level and turning left along the elevated cross lanes. The left turn lane would then continue on the elevated level, on the so called "wrong side" of the cross lanes, and cross over to the "right side" only after the cross lanes have descended, and then the left turn lane would descend onto the cross street. The ramps for the through traffic would begin in advance and end spaced, after the intersection leaving space for the left turn ramps to reach the road level.

A combination of succeeding overpasses on a major road together with partial enclosing of the inner lanes, would provide "Express Lanes" where traffic could move at greater speeds. Openings of the enclosures would be provided at certain stretches permitting the interchange between the regular lanes and the "Express Lanes".

DESCRIPTIONS OF THE DRAWINGS

FIG. 10 is a view from one end of a "U" type element similar to FIG. 3 but formed of plates.

FIG. 12 is a partly sectional showing the modular structure made in part from plates, also showing screws in the base element for alignment of the column;

FIG. 13 is a sectional view of a bearing resting on a support and a structural bridge part extending into that bearing and held in secure position for both upward and downward pressure by means of cores inserted as based on this invention;

DESCRIPTION OF AN PREFERED EMBODIMENT

Figure 1:
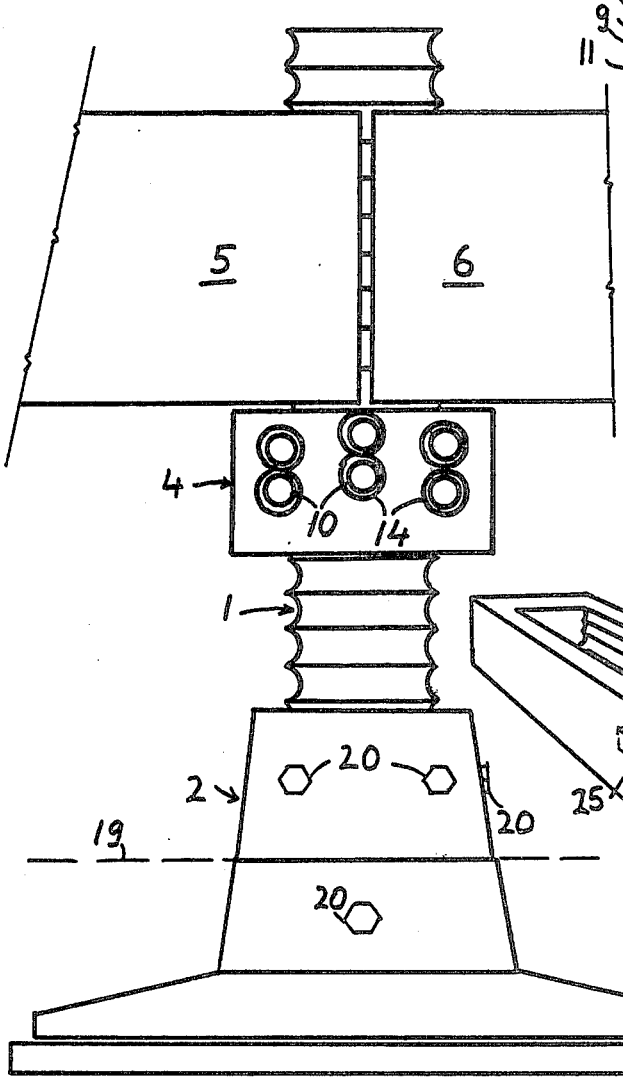
FIG. 1 is an elevation showing the modular elements assembled as a road carrying structure viewed from one longitudinal side.
Figure 16:
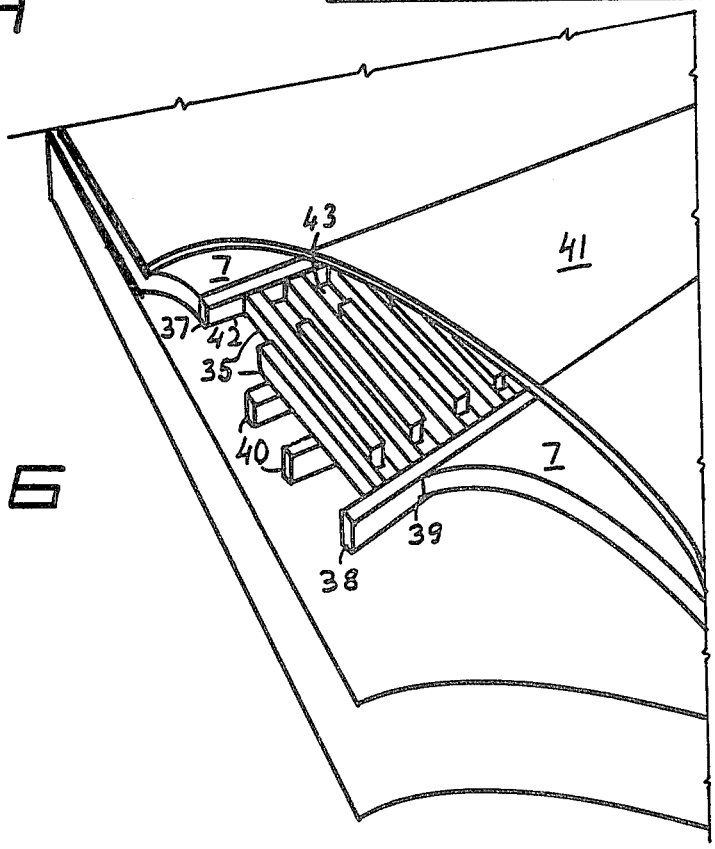
FIG. 16 is a cutaway view of the expansion joint, for the road surface showing the joint structure.

Refering now in particular to FIG. 1, a column 1 is shown supporting a beam 4 on which carrying elements 5 and 6 connected with an expansion-joint have been positioned. The column is held up by the base 2 which is resting on the foundation prepared at the side 3. The base 2 is partly submerged below the road surface level 19, and has large screws 20 serving for adjustment of the column 1 and the respective alignment. Inserts 10 have been inserted in the openings 14 provided for securing the connected elements FIG. 16 shows expansion joint.

Figure 2:
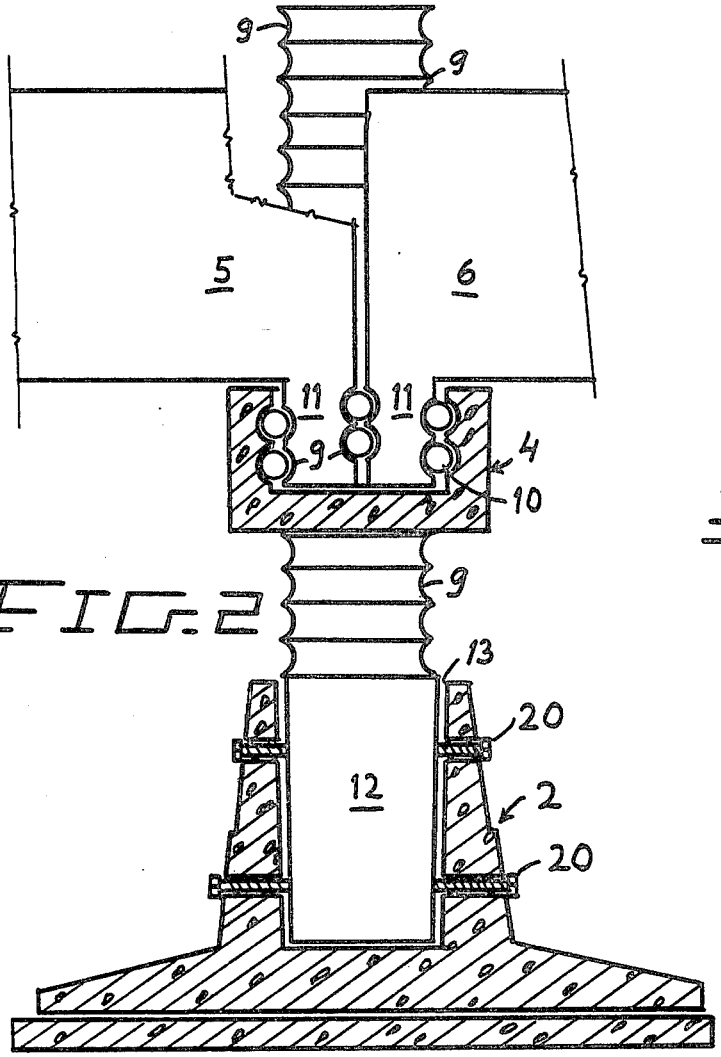
FIG. 2 is a partly sectional view showing the mode of assembly of the modular structure shown in FIG. 1.

FIG. 2 shows the column 1 resting with its lower part 12 in the base 2 and adjusted for alignment by screws 20 in the opening of the base 13. The column 1 is provided with half round flutings 9. A beam 4 is positioned and secured to the column by inserting insert 10 between the flutings of the column and the flutings 9 of the beam 4. The inserts 10 extend from the column into the beam where carrying elements 5 and 6 are resting with their foot 11 and are secured by the inserts 10 extending into the fluting provided in these foots. Similar inserts 10 are inserted between the two feet 11 of the carrying elements 5 and 6 and provide also the required opposing support. The fluting on the column permits the positioning at any given and required height of a support beam. Inserts can be inserted by pressure, or cast where no flexibility is required. Use of flexible, rubber and hollow core as inserts will provide any required degree of flexibility.

Figure 3:
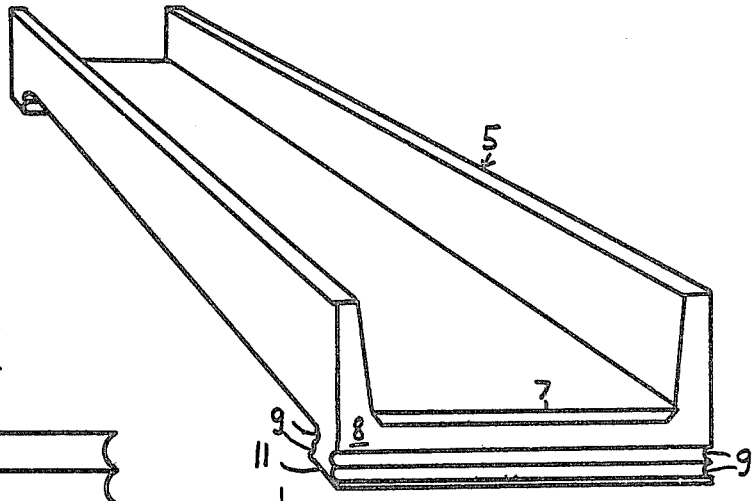
FIG. 3 is showing the "U" shaped element viewed from one end.
Figure 4:
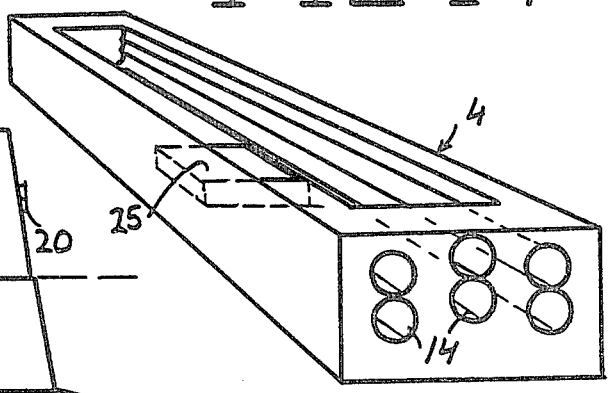
FIG. 4 is showing a support beam viewed from one end.
Figure 5:
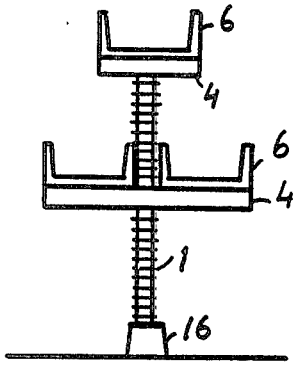
FIG. 5 shows a transverse sectional view of an overpass system composed of three lanes on one column.

A typical "U" shaped carrying element is shown in FIGS. 3 and 5. The foot 11 is provided from two sides with half round flutings 9. Road surfacing 7 rests on the horizontal part 8 of the element. The beam 4 shown in FIG. 4 is provided on the hollowed inside with flutings 9 which extend to the outside as openings 14. An opening through the bottom of the beam is provided as 25 through which the column extends upward.

Figure 6:
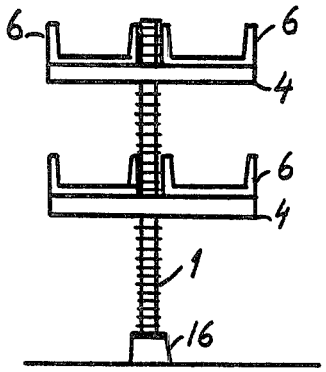
FIG. 6 shows a transverse sectional view of an overpass system composed of four lanes on one column.

In FIG. 5 three lanes 6 are positioned on column 1 extending from the top part 16 of the base. A supporting beam 4 is positioned at the first level and supporting one lane on each side of the column. On the second upper level a beam 4 is supported and riding on the column, and supporting an upper lane 6. In FIG. 6 supporting beams 4 are positioned at two levels and carrying one lane on each side of each level.

Figure 7:
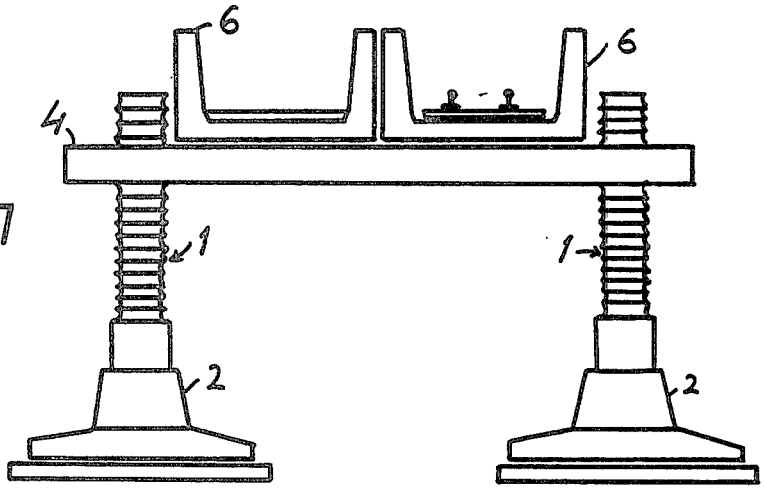
FIG. 7 shows a transverse sectional view of an overpass system with two lanes and rails between two columns.

FIG. 7 shows a supporting beam 4 positioned on two columns 1, on each side, and the beams supporting 2 carrying elements on one of which railway tracks have been secured.

Figure 8:
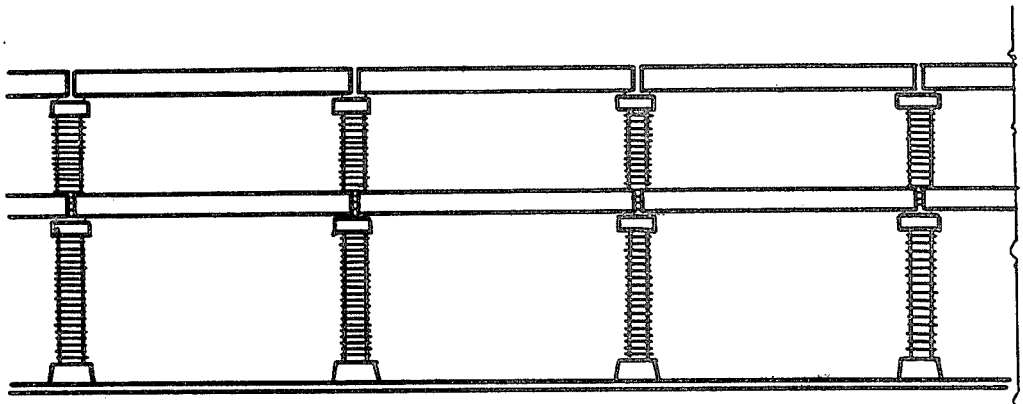
FIG. 8 is a side view of two-level elevated lanes.
Figure 9:
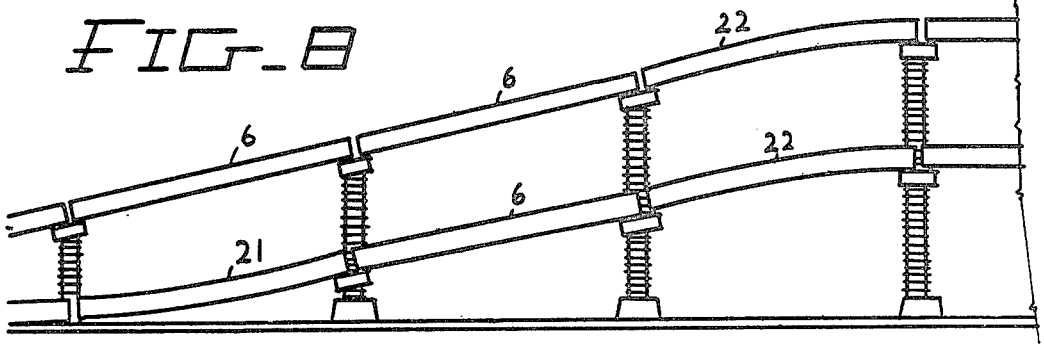
FIG. 9 is a side view of a two-level ramp.

FIG. 8 shows part of a dual level elevated roadway, and FIG. 9 shows in a side view the use of thre different lane elements. The standard element serving for all straight lanes is shown as 6, a slope starting element is shown as 21, and a slope ending element is shown as 22.

An alternative embodiment of the lane element is shown in FIG. 10 while the lane element shown in FIG. 3 is precast of materials such as reinforced concrete, this lane element is formed from sheet material such as mild steel.

A plate formed "U" shaped carrying element is shown in FIG. 10 as alternative embodiment of the precast element. Lighting fixtures for iluminating the lane are shown at 30 and for lower roadway utility conduit ilumination at 31.

Figure 11:
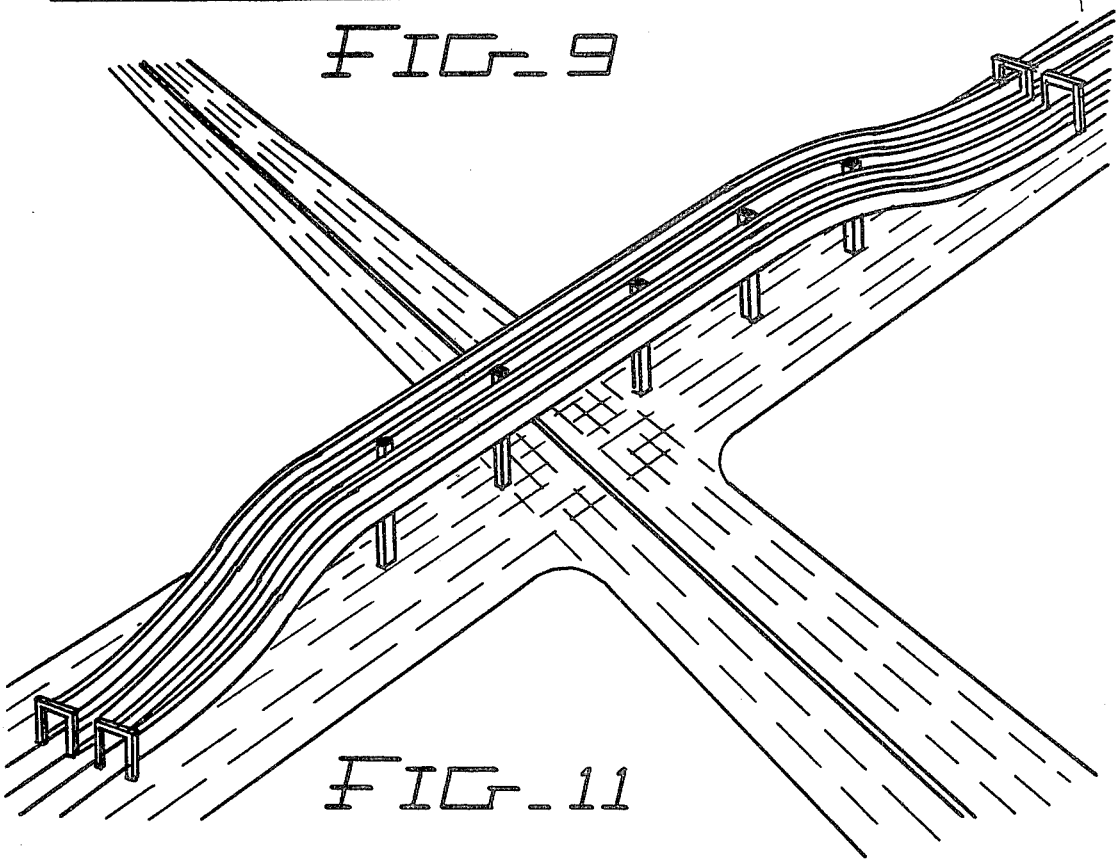
FIG. 11 is a perspective view of a double lane overpass for light traffic with gate type structures providing for physical limitation to the entrance of higher vehicles.

A perspective of a two lane overpass at a road intersection is shown in FIG. 11. Gate type structures 32 have been added to provide a physical limitation to the entry of higher vehicles, and for the purpose of symetry the same type gates have been added at the exits.

Figure 14:
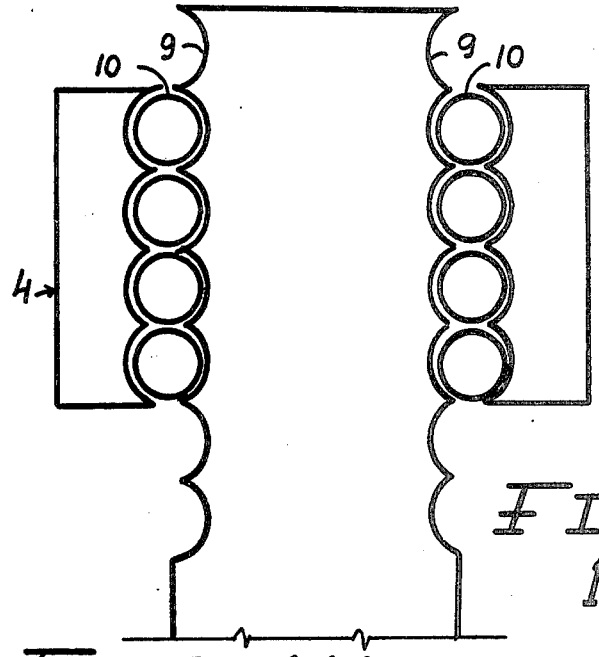
FIG. 14 is another sectional view of part of the column with a beam and inserted cores.

In FIG. 12 a plate formed embodiment is shown as positioned for assembly into a column 1 with the alignment screws 20 for the alignment of the column in the base 2. FIG. 14 shows a section of a precast column with the cores 10 inserted between the fluting 9 of the beam 4 and the column 1.

A bearing for use to position the end of ramps of said assembly and structures such as bridges in general is shown in FIG. 13. The foot 11 of the carrying element 6 is shown inserted into the bearing assembly 34 which rests on the support 36. Two cores 10 made of strong material with a hollow center are inserted between the flutings 9 of the foot 11 and the opposing flutings 9 of bearing members 35. Thus the bridge type structure is resting on the opposing cores and secured against upward or downward movements as may be caused by outside pressures.

Figure 15:
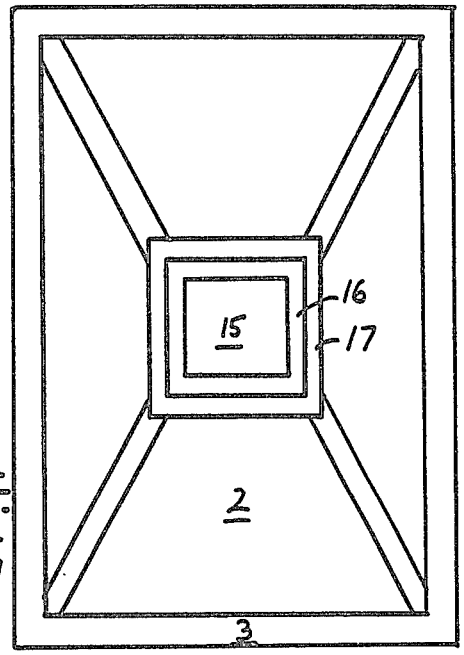
FIG. 15 is a plan of the base, foundation and column.

A view from above showing the base 2 positioned on the foundation 3 is shown in FIG. 15. The opening for the insertion of a column is shown at 15 and the top part of the base at 16 and the vertically slanted upper part of said base at 17.

An improved type of expansion joint is shown in FIG. 16 to provide for uninterrupted road surfaces 7 on the lane elements 5 and 6. In this cut-away bars 35 extend from each side 37 and 38, being mounted in assemblies 39. The bars of each assembly are spaced to receive the bars of the opposing assembly, which slide in while resting on 40 and are covered by stretchable material 41. Openings 43 are provided for drainage.

What is claimed is:

1. A bridge structure of modular elements comprising:

a. a plurality of spaced bases each formed with an upper opening for the insertion of a colum;

b. a plurality of columns formed inserted in each said opening an with horizontal flutings dimensioned for the insertion of cores between said flutings and complementary flutings in the an other components to be fastened to said columns and serving as variable positioning means for horizontal beams c. a shetled position beam on said column also provided with said complementary flutings and cores as securing means to said column and to road carrying elements d. said road forming elements being provided with fluted means positioning and securing said element on said beams and on foundations provided with complementary securing means.

2. The structure of claim 1, wherein each base is provided with means such as screws, for the adjustment and alignment of the inserted column;

3. The structure of claim 1, wherein the column is formed with horizontal flutings for the purpose of securing the positioning of other elements;

4. The structure of claim 3, wherein the beams also are provided with flutings dimensioned to receive one side of an inserted core, with the other side of the core being positioned in the respective fluting of the other element to be assembled.

5. The structure of claim 1, wherein the road forming elements are of a semi "U" shape form and are dimensioned to be self supporting structures resting on their respective foundation and forming one complete lane.

6. The structure of claim 1, wherein the road forming elements are self supporting structures made in a semi-"H" shaped form 7. In the bridges structure of claim 1 A surface expansion joint located between road forming elements comprising two interacting assemblies each composed of a plurality of bars mounted with spacing therebetween on a base and wherein the bars of each assembly extend (extending) into the spaces of the opposing assembly.

8. In a expansion joint of claim 7, wherein the parts of the bars extending from one assembly are sliding between the bars and on the base of the opposing assembly.

9. The expansion joint of claim 7, wherein the whole expansion joint is covered with durable and stretchable material.

10. The expansion joint of claim 7, wherein the assemblies have downward openings permitting dirt and other particulars to pass through.

11. The structure of claim 1, wherein the road forming elements are provided with ducts to carry utilities.

* * * * *

UNITED STATES PATENT AND TRADEMARK OFFICE

CERTIFICATE OF CORRECTION

PATENT NO. : 4,181,995

DATED : January 8, 1980

INVENTOR(S) : Henry C. Zur

It is certified that error appears in the above—identified patent and that said Letters Patent is hereby corrected as shown below:

Claim 1, lines 5 and 6 should read:

-- b. a plurality of columns, inserted in each said openings and formed with horizontal fluting dimensioned --

Claim 1, line 11 should read:

-- c. a slotted beam positioned on said column also pro- --.

Signed and Sealed this

*Eighth* Day of *July 1980*

[SEAL]

*Attest:*

SIDNEY A. DIAMOND

*Attesting Officer*

*Commissioner of Patents and Trademarks*